United States Patent [19]

Swergold

[11] Patent Number: 4,901,381

[45] Date of Patent: Feb. 20, 1990

[54] SUPPORT APPARATUS FOR HAMMOCKS

[76] Inventor: Gary D. Swergold, 8413 Buckhannon Dr., Bethesda, Md. 20854

[21] Appl. No.: 346,194

[22] Filed: May 2, 1989

[51] Int. Cl.[4] ..... A45F 3/24; A45F 3/22

[52] U.S. Cl. ..... 5/127; 5/120

[58] Field of Search ..... 5/127–130, 5/120, 121, 124

[56] References Cited

U.S. PATENT DOCUMENTS

| | | | |
|---|---|---|---|
| 986,375 | 3/1911 | Fitzner et al. | 5/127 |
| 1,257,984 | 3/1918 | Drexler | 5/124 |
| 3,315,281 | 4/1967 | Morris | 5/120 |
| 4,662,132 | 5/1987 | Tennant | 52/148 |
| 4,691,394 | 9/1987 | Woo | 5/120 |

FOREIGN PATENT DOCUMENTS

| | | | |
|---|---|---|---|
| 2540693 | 1/1977 | Fed. Rep. of Germany | 5/127 |
| 1417286 | 10/1965 | France | 5/120 |
| 421191 | 12/1934 | United Kingdom | 5/129 |

*Primary Examiner*—Alexander Grosz

*Attorney, Agent, or Firm*—Henderson & Sturm

[57] ABSTRACT

A support apparatus (10) for a conventional hammock (100) wherein the support apparatus (10) includes a pair of generally triangular support members (14) operatively connected to anchor members (30) by tether means (12).

7 Claims, 1 Drawing Sheet

FIG. 1.
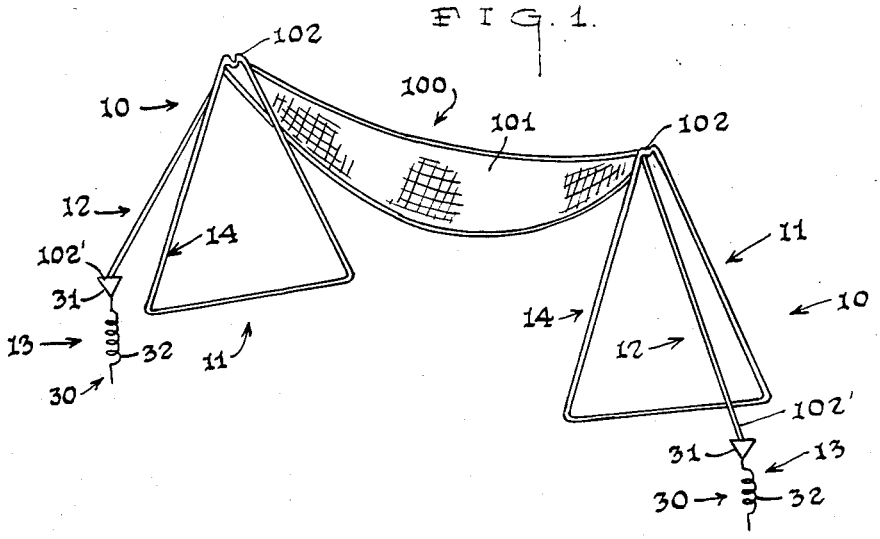
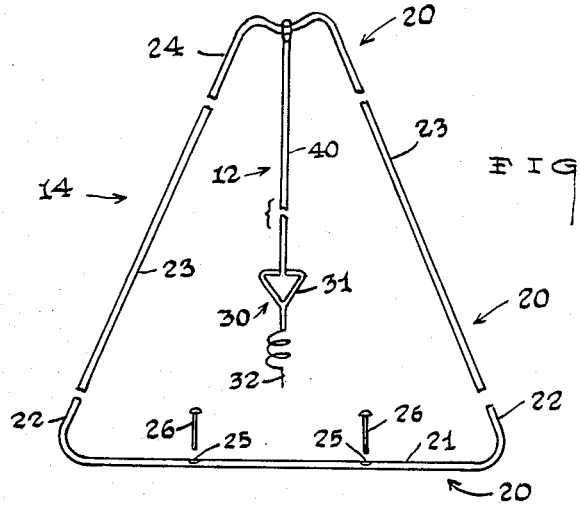
FIG. 2.
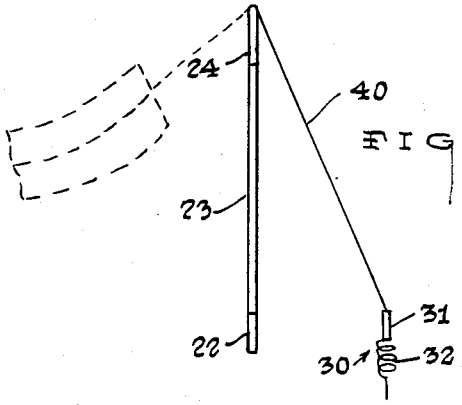
FIG. 3.

SUPPORT APPARATUS FOR HAMMOCKS

TECHNICAL FIELD

The present invention relates generally to the field of hammock supports, and more particularly to collapsible hammock supports.

BACKGROUND OF THE INVENTION

As can be seen by reference to the following U.S. Pat. Nos. 4,691,394; 4,662,132; 1,257,984 and 3,315,218 the prior art is replete with myriad and diverse support structures for hammocks.

While all of the aforementioned prior art devices are more than adequate for the basic function for which they were specifically designed, only the Drexler and Tennant patents address the area of concern of the present invention. To wit, this invention is directed to the provision of a lightweight collapsible or break down arrangement for hammock supports; whereby, the hammock can be suspended from the supports in generally flat barren areas such as beaches, lawns, etc. which are devoid of trees or other typical hammock supporting structures.

It should further be noted that while others have acknowledged and addressed the problem of pitching hammock in relatively desolate areas, their proposed solutions have been notably deficient with regard to both the stability of the vertical support member and their requirement for a plurality of tie down anchors to compensate for their inherently unstable supports.

As a consequence of the foregoing situation there has existed a long standing need among those individuals concerned with this area of technology for a simple, efficient, compact and stable support apparatus for hammocks which only requires a single tie down anchor associated with each support member; and, the provision of such a device is a stated objective of the present invention.

SUMMARY OF THE INVENTION

Briefly stated, the support apparatus for hammocks that forms the basis of the present invention comprises in general: a pair of support units wherein each of the support units are provided with tether means and an anchor unit.

In addition, each of the support units comprises a generally triangular support member wherein each of the support members includes a plurality of generally tubular sections which are detachably engaged with one another to form the generally triangular configuration of the support member.

Furthermore, the plurality of generally tubular sections comprise: an elongated base section; a pair of side sections; and, a contoured top section. The base section is dimensioned and configured to provide a relatively long stable support surface for both ends of a hammock, particularly in a packed granular environment such as sandy beaches or the like; and the base member is also adapted to receive one or more anchor spikes for harder or slipperier surfaces such as wet grass; wherein, the anchor spikes will prevent slippage of the support members relative to the hammock.

As will be explained in greater detail further on in the specification the support units of this invention require only a single tether unit and anchor unit on each end of the hammock to provide a stable support apparatus for the hammock. In addition, all of the components of the apparatus are very light and compact such that the transport of the hammock and the support apparatus is greatly facilitated.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a perspective view of the support apparatus deployed on a hammock;

FIG. 2 is an isolated, exploded perspective view of the support apparatus; and, FIG. 3 is a side plan view of the apparatus.

BEST MODE FOR CARRYING OUT THE INVENTION

As can be seen by reference to the drawings and in particular to FIG. 1, the support apparatus that forms the basis of the present invention is designated generally by the reference numeral (10) and is designed and intended for use with a conventional hammock construction (100) including a hammock body (101) having hammock tether means (102) provided on opposite ends of the hammock body (101).

The support apparatus (10) comprises in general: a pair of support units (11) wherein each support unit (11) is provided with tether means (12) and an anchor unit (13). These units will now be described in seriatim fashion.

As shown n FIGS. 1 thru 3, each of the pair of support units (11) comprises a generally triangular support member (14) which includes a plurality of detachably interconnected tubular sections (20). The detachably interconnected tubular sections (20) comprise an elongated generally U-shaped base section (21) having upturned and inwardly angled ends (22); a pair of elongated side sections (23); and, a generally inverted W-shaped top section (24); which connect together to form the generally triangular configuration of each support member (14).

In addition, each of the base sections (21) are provided with at least one aperture (25) that is dimensioned to accommodate at least one anchor spike (26). However, as a practical matter the base sections (21) in the preferred embodiment are provided with a plurality of apertures (25) dimensioned to accommodate a like plurality of anchor spikes (26) to prevent the displacement of the respective base sections (21) relative to the hammock (100) when the apparatus (10) is deployed on a hard and/or slippery surface as mentioned supra.

As can also be seen by reference to FIGS. 1 thru 3, each of the anchor units (13) comprises a generally conventional ground piercing anchor member (30) including a handle element (31) and an auger screw element (32) which operate in a well recognized manner to penetrate the earth, soil, or sand. It should also be noted that for the purposes of this invention any suitable earth anchor member or deadman device can be substituted for the anchor members (30) depicted in the drawings.

Turning now specifically to FIG. 3, it can be seen that in one version of the preferred embodiment of this invention the tether means (12) comprises a separate tether member (40) that are operatively connected between each of the handle elements (31) of the anchor members (30) and the top sections (24) of the respective support members (14) while the hammock tether means (102) are also connected to the top sections (24) of the respective support members (14).

However, in another version of the preferred embodiment depicted in FIG. 1, the hammock tether means (102) also serve as the apparatus tether means (12) in that the ends (102') of the hammock tether means (102) are operatively secured to the handle elements (31) of the anchor members (30) while an intermediate portion of the hammock tether means (102) are operatively engaged with the top sections (24) of the support members (14).

It should also be appreciated at this juncture that the support apparatus (10) described herein is equally adaptable to either granular or firmer substrates; wherein, the base section (21) will either settle into a sandy environment, or is adapted to anchored into firmer ground by the provision of the anchor spikes (26).

In addition, all of the components of the support units (11) are to be fabricated from lightweight material such as aluminum tubing or the like; and, since the tubing sections (20) are adapted to be detachably connected to one another the support members (14) may be disassembled into a compact, lightweight bundle for ease of transportation.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A support apparatus for conventional hammock constructions including a hammock body and hammock tether means disposed on opposite ends of the hammock body wherein the support apparatus comprises:

a pair of support units operatively associated with the hammock tether means wherein each of the- support units comprises a generally triangular support member, supported on a support surface, which includes a plurality of detachably interconnected tubular sections comprising an elongated base section; a pair of elongated side sections; and, a top section, said support units being disposed in substantially vertical planes that are substantially parallel to each other, said support units being connected to each other solely by the hammock tether means, and being held in said substantially vertical planes by stabilizing means connecting the top sections to the support surface.

2. The support apparatus as in claim 1 wherein said base section has a generally U-shaped configuration including a pair of upturned and inwardly angled ends.

3. The support apparatus as in claim 2 wherein said top section has a generally inverted W-shaped configuration.

4. The support apparatus as in claim 1 wherein said stabilizing means comprises a tether means; and, a pair of anchor units.

5. The support apparatus as in claim 4 wherein each of the anchor units comprises an anchor member having a handle element and an auger screw element.

6. The support apparatus as in claim 4 wherein the tether means comprise separate tether members that are operatively connected between each of the anchor members and said support members.

7. The support apparatus as in claim 5 wherein the tether means and the hammock tether means are the same.

* * * * *